US006755702B2

(12) United States Patent
Mele

(10) Patent No.: US 6,755,702 B2
(45) Date of Patent: Jun. 29, 2004

(54) POWERED WATERCRAFT

(76) Inventor: Peter Mele, P.O. Box 533, Crown Point, NY (US) 12928

( * ) Notice: Subject to any disclaimer, the term of this patent is extended or adjusted under 35 U.S.C. 154(b) by 0 days.

(21) Appl. No.: 10/236,225

(22) Filed: Sep. 5, 2002

(65) Prior Publication Data

US 2004/0048526 A1 Mar. 11, 2004

(51) Int. Cl.[7] ..... B63H 11/00
(52) U.S. Cl. ..... 440/38; 114/151
(58) Field of Search ..... 440/38, 40, 42, 440/43, 47, 44; 114/151; 441/128, 130, 132, 65

(56) References Cited

U.S. PATENT DOCUMENTS 2,730,065 A * 1/1956 Piper ..... 440/38
3,142,285 A * 7/1964 Sorrentino et al. ..... 440/42
3,372,667 A * 3/1968 Sweet ..... 440/40
3,400,682 A * 9/1968 Jones, Jr. ..... 114/151
3,933,113 A * 1/1976 Dornak, Jr. ..... 440/42
3,943,876 A * 3/1976 Kiekhaefer ..... 440/43
4,115,888 A * 9/1978 Sievers ..... 440/38
4,681,550 A * 7/1987 Koenig ..... 440/40
5,863,229 A * 1/1999 Matte ..... 440/47
5,879,214 A * 3/1999 Bentley ..... 441/65
6,004,173 A * 12/1999 Schott ..... 440/38
6,520,814 B1 * 2/2003 Elias et al. ..... 440/38

* cited by examiner

*Primary Examiner*—S. Joseph Morand
*Assistant Examiner*—Lars A. Olson
(74) *Attorney, Agent, or Firm*—George Kersey

(57) ABSTRACT

Aquatic propulsion apparatus formed by a channeled outlet member; a channeled inlet member extending into the outlet member; with pressure applied in the channel of the outlet member surrounding the channel of the inlet member, which extends into the outlet member; the apparatus for powering a watercraft, having an interior and a bottom surface, has the inlet member as a tube extending from the interior through the bottom surface, with the outlet member surrounding the inlet member below the bottom surface, where a source of pressure is applied.

19 Claims, 4 Drawing Sheets

POWERED WATERCRAFT

BACKGROUND OF THE INVENTION

This invention relates to watercraft capable of being occupied by one or more persons and adapted for recreational use on relatively congested aquatic surfaces and, more particularly, to recreational watercraft that can produce a jet sound effect during propulsion.

Conventional watercraft employ propellers driven by internal combustion engines or battery operated electric motors to provide propulsion. Such watercraft often are operated in an environment where rotating propellers can provide a hazard, for example, to swimmers and aquatic animals.

In addition, engine driven propellers are expensive to operate and their mechanisms are relatively complex, so that their use is undesirable for use in congested areas such as pools in recreational areas and amusement parks.

Another consideration is that the operation of a motor-propelled watercraft can be more difficult than the operation of a vehicle on land. As a result, it often is necessary to provide special training for persons assigned to their operation, particularly when there can be a possible hazardous to others.

Accordingly, it is an object of the invention to provide propelled watercraft which are relatively stable and harmless in operation.

Another object of the invention is to provide propellable watercraft which can be used in swimming pools and other recreational areas A further object of the invention is to provide a relatively inexpensive watercraft which are simple to operate.

A still further object of the invention is to provide a novel accessory for the self-propulsion of watercraft using a source of pressurized fluid to produce propulsion.

Yet another object of the invention is to provide watercraft propulsion by a jet of pressurized fluid that is accompanied by jet sound and produces a stable operation for both forward and turning movements.

Still another object of the invention is to provide inexpensive self-propelled watercraft which are relatively simple in both operation and construction It also is an object of the invention to provide a water jet infused with air bubbles to demonstrate a scientific principle associated with water jets.

SUMMARY OF THE INVENTION

In accomplishing the foregoing and related objects, the invention provides for powering watercraft by a controller with an inlet member that can extend from the interior of the craft through its bottom. The inlet member has a channel that extends into an outlet channel below the position where the inlet member is to extend through the bottom of the craft. A source of fluid pressure is connected to the outlet member with the result that material entering the inlet can flow from the outlet simultaneously with material from a pressure source.

When the controller of the invention is affixed to a watercraft placed in a body of water, and a hose is connected to the outlet channel, a jet of water from the outlet provides propulsion and the simultaneous exit of inlet air from the outlet produces a jet sound and visual bubbles that provide an understanding for the principle of operation.

In accordance with one aspect of the invention, a steering column is removably positioned on the inlet member, which can be tubular. The outlet member also can be tubular and be orthogonally positioned in relation to the inlet member, with the source of pressure applied to the outlet channel.

When the source of pressure is connected to a hose, a swivel joint can be provided for ease of connection to the outlet member, and the inlet member within a watercraft can be surrounded by a bushing.

In accordance with a further aspect of the invention the inlet member can have a removable muffler to control the sound produced by air entering the inlet and exhausted through the outlet.

In a method of the invention for powering a watercraft, an inlet member is inserted into the craft through its bottom, with a channel of the inlet member extending into an outlet member below the craft. A source of pressure is connected to the outlet member to provide flow in an outlet channel surrounding the extension of the inlet channel into the outlet member.

In accordance with one aspect of the method, a steering column is removably positioned on the inlet member within the watercraft, and the outlet member is angularly positioned with respect to the extension of the inlet member below the watercraft. Pressure from a source is applied to the outlet channel, for example by a hose.

The method can further including the step of positioning a removable muffler on the inlet member to control the sound produced by air entering the inlet and exhausted through the outlet.

In a method of the invention for manufacturing a controller for powering watercraft, the steps include (a) fabricating a hollow steering column for extending through the base of a watercraft; (b) attaching a hollow outlet tube to said steering column below the position where said steering column is designed to extend through said base; and (c) providing for the attachment of a pressurized source to the outlet tube.

The method also includes the positioning of a deflector for channeling air into the inlet member.

DESCRIPTION OF THE DRAWINGS

Other aspects of the invention will become apparent after considering several illustrative embodiments, taken in conjunction with the drawings in which.

DETAILED DESCRIPTION

Figure 1:
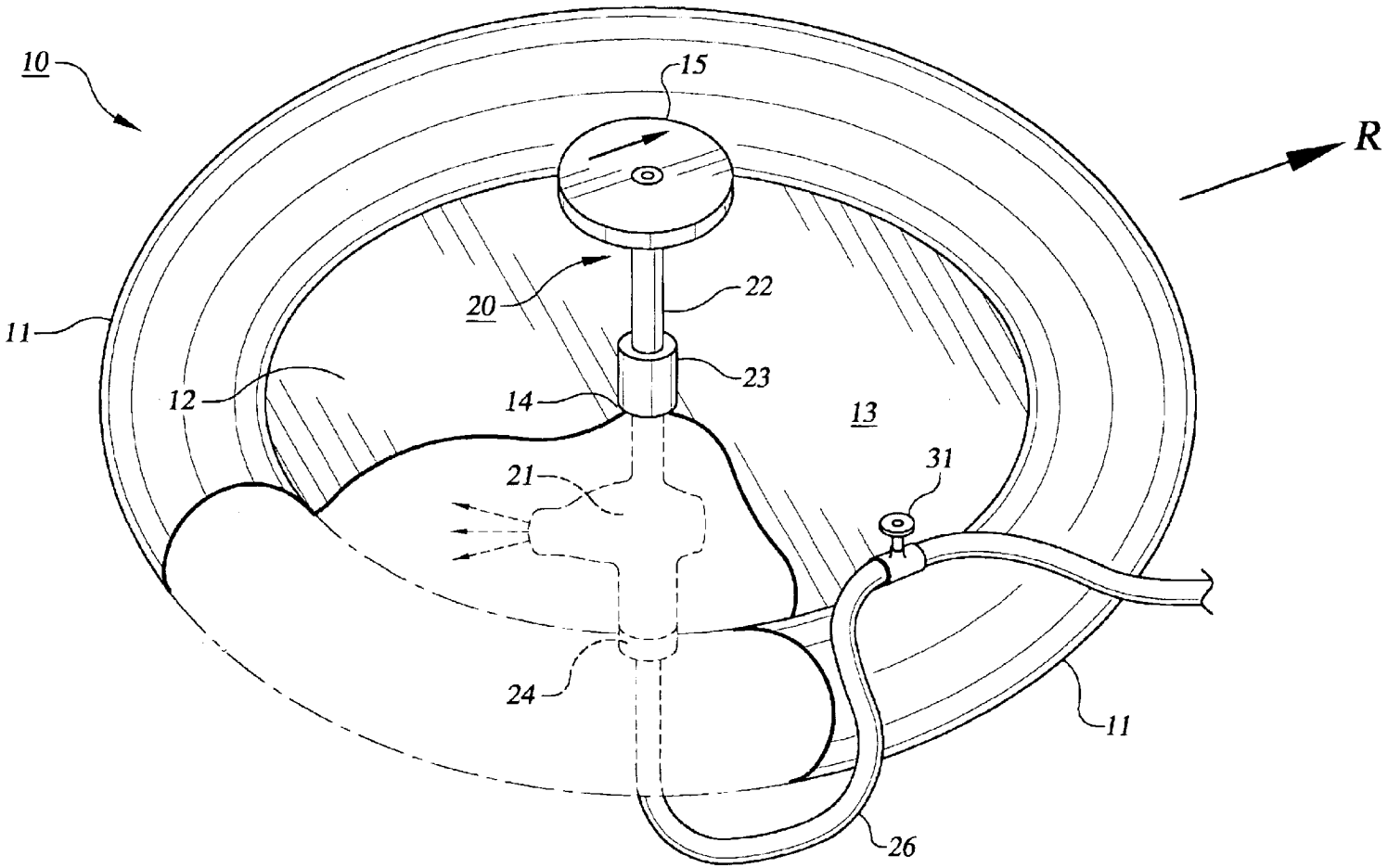
FIG. 1 is a partial perspective view of a watercraft with the controller of the invention.

With reference to the drawings, a watercraft 10 may be of any convenient size and configuration, with the configuration of FIG. 1 having been found to be relatively stable in operation when occupied by one or a few persons. The watercraft 10 may be of any convenient construction and formed from such materials as foamed or expanded polymers, expanded styrene, or vacuum formed sheet plastic joined together to form a hollow hull. In the configuration shown, the watercraft 10 has a doughnut shaped surface 11 and a bottom 12 that may be flat and clear for display of items below the bottom.

The watercraft 10 is provided with a passenger compartment 13 and a controller 20 mounted at a position 14 of the passenger compartment 13 The mounting position 14 for the controller 20 may be at the center of the passenger compartment 13, or it may off-center.

Figure 2:
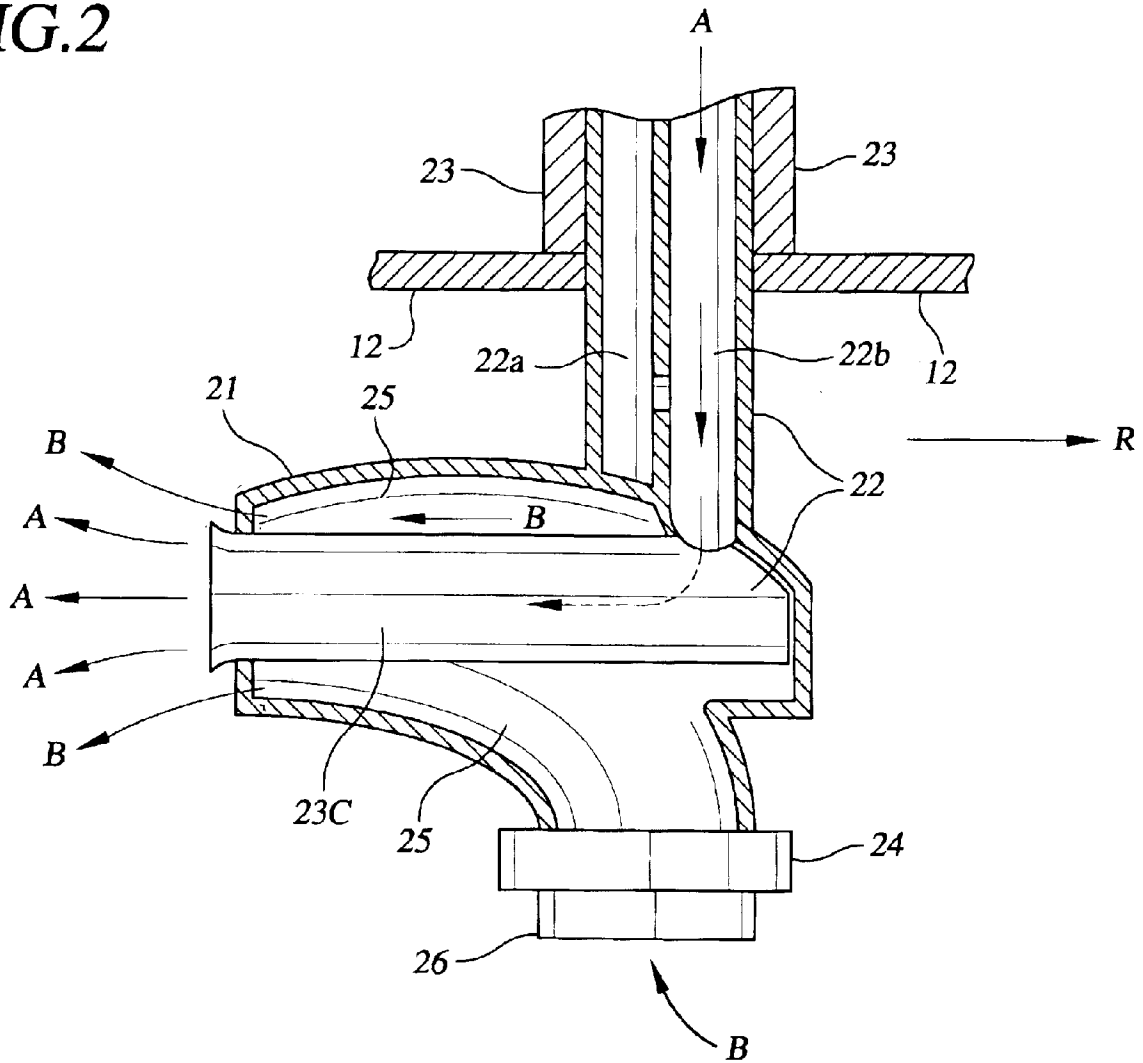
FIG. 2 is a view, partially in section, showing details for the controller of FIG. 1.

The controller 20, shown in detail in FIG. 2, has an outlet nozzle 21 that is connected to an inlet member 22 which extends upwardly into the craft 10 through the flat bottom 12. A retention bushing 23 in contact with the flat bottom 12 surrounds the inlet member 22 and holds it in place.

The inlet member 22 is tubular with inlet channels 22*a* and 22*b* for the flow indicated by arrows A of material into a further inlet channel 23*c*, and out of the nozzle 21. During propulsion of the craft 10, this air flow produces a jet sound and a visual display of exhaust bubbles.

Propulsion is achieved by attaching a hose 26 to a swivel joint 24 of the nozzle 21 to allow water from a source (not shown) connected to the hose 26 to enter the outlet channel 25 which surrounds the inlet channel extension 23*c*. Accordingly, water flow, indicated by the arrows B, emerges simultaneously from the nozzle 21 with air flow.

The motion of the craft 10 depends upon the orientation of the nozzle 21. In the position shown in FIGS. 1 and 2, with the nozzle 21 extending to the left, the motion of the craft 10 is to the right, as indicated by the arrow R. To permit changes of direction a removable steering wheel 15 is attached to the inlet member 22 as shown in FIG. 1.

In order to control the fluid flow into the outlet channel 25, the hose 26 can include a valve 31 mounted on the craft 10, also as shown in FIG. 1. Otherwise it is necessary to use the valve at the connection of the hose 26 to the pressure source (not shown).

Figure 3A:
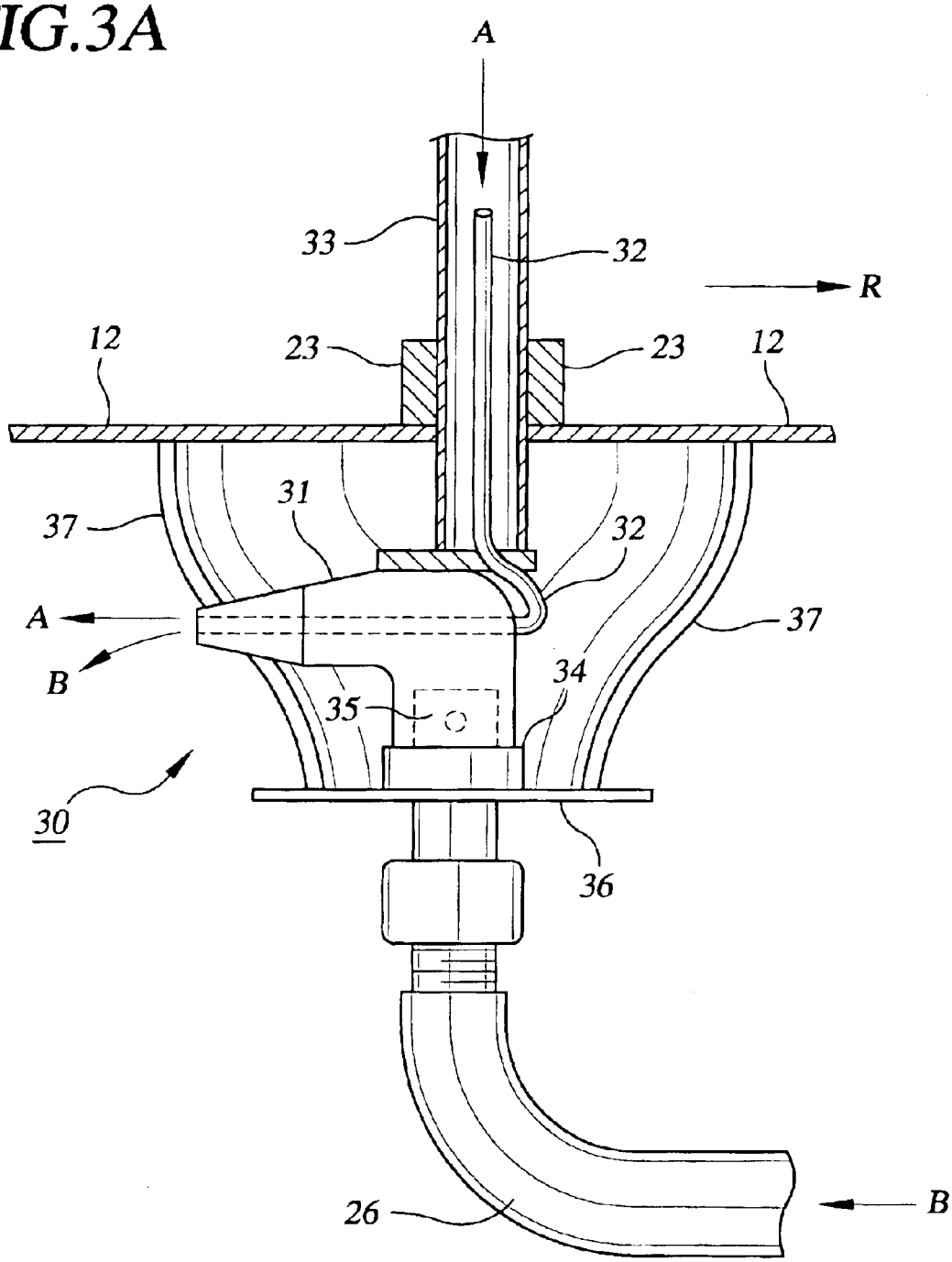
FIG. 3A is a view, partially in section, of an alternative controller in accordance with the invention.
Figure 3B:
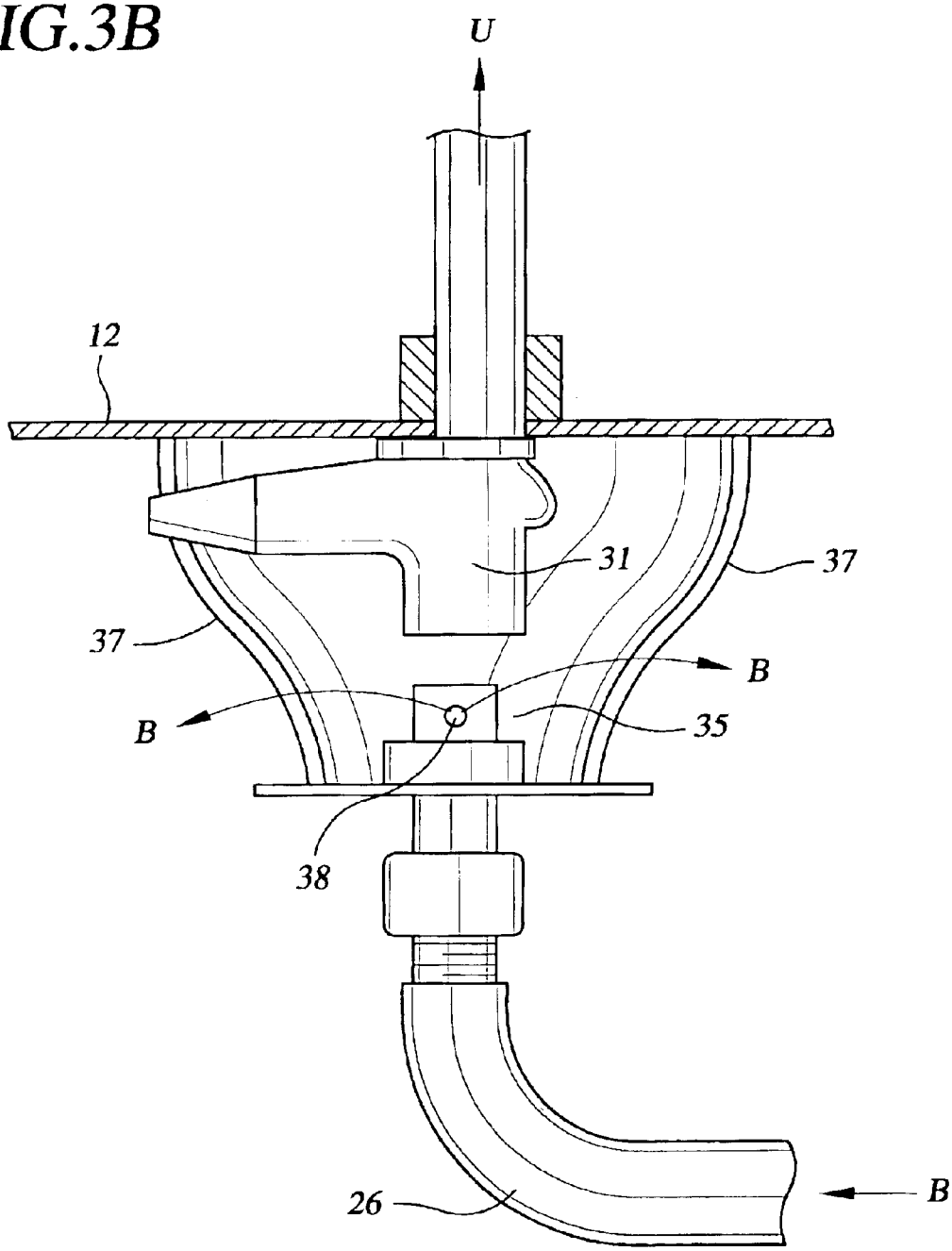
FIG. 3B is a view illustrating any operation of the controller of FIG. 3A.

Alternatively, to avoid the need for control at the connection of the hose 26 to the pressure source, the controller 30 of FIGS. 3A and 3B can be employed.

The controller 30 has an outlet nozzle 31 surrounds an inlet member 32 which extends upwardly a short distance into the steering column 33 of the craft through the flat bottom 12. A retention bushing 23 in contact with the flat bottom 12 surrounds the steering column 33 and holds it in place.

The outlet nozzle 31 has its base 34 surrounding a tubular outlet member 35, which is held against the nozzle 31 by a platform 36 and rods 37 connected to the bottom 12. During propulsion of the craft 10, air flow A produces a jet sound and a visual display of exhaust bubbles.

In order to terminate propulsion without the need for shutting water from the source (not shown), the controller 30 is elevated by upward pull and water pressure on the steering column 33 as shown in FIG. 3B and indicated by the arrow U. This allows the source water to exit though the aperture 38 of the outlet member 35 and prevents any further operation of the nozzle 31. When the steering column is pushed downwardly so that the base 34 of the nozzle 31 surround the outlet member 35, the prior operation of FIG. 3A is resumed.

It will be understood that the foregoing detailed description is illustrative only and that modifications and adaptations may be made without departing from the spirit and scope of the invention as defined by the appended claims.

What is claimed:

1. Propulsion apparatus comprising a channeled outlet member; a channeled inlet member extending into said outlet member; and means for applying pressure in the channel of said outlet member surrounding the channel of said inlet member extending into said outlet member for powering a watercraft having an interior and a bottom surface, wherein said inlet member is a tube extending from said interior through said bottom surface; said outlet member surrounds said inlet member below said bottom surface; and means for applying a source of pressure to said outlet.

2. Apparatus as defined in claim 1, further including a steering column positioned on said inlet member.

3. Apparatus as defined in claim 1, wherein said outlet member is in the form of tube orthogonally positioned in relation to said inlet member.

4. Apparatus as defined in claim 2, wherein said source of pressure is applied to said outlet member below said inlet member.

5. Apparatus as defined in claim 3, wherein said source of pressure is applied from an aquatic source.

6. Apparatus as defined in claim 5, wherein said aquatic source is connected to said outlet member by a hose.

7. Apparatus as defined in claim 6, wherein said hose is connected to said tubular member at a swivel joint.

8. Propulsion apparatus comprising a channeled outlet member; a channeled air inlet member extending into said outlet member; and means for applying pressure in the channel of said outlet member surrounding the channel of said inlet member extending into said outlet member, wherein said inlet member within a watercraft is surrounded by a bushing.

9. Propulsion apparatus comprising a channeled outlet member; a channeled air inlet member extending into said outlet member; and means for applying pressure in the channel of said outlet member surrounding the channel of said inlet member extending into said outlet member, wherein said inlet member has a removable muffler; thereby to control the sound produced by air entering said inlet member and exhausted through said outlet member.

10. A method for powering a watercraft having an interior and a bottom surface, comprising the steps of:

(a) extending a tubular member from said interior through said bottom surface;

(b) connecting an outlet to said tubular member below said bottom surface;

(c) providing means for deflecting an air stream entering said tubular member into said outlet member; and (d) applying a source of pressure to said outlet member.

11. The method as defined in claim 10, further including the step of positioning a steering column on said tubular member.

12. The method as defined in claim 11, further including the step of orthogonally positioning said outlet in the form of a tube in relation to said tubular member.

13. The method as defined in claim 12, further including the step of applying said tube to said source of pressure below said tubular member.

14. The method as defined in claim 13, further including the step of applying pressure to said tube below said tubular member from an aquatic source.

15. The method as defined in claim 10, further including the step of connecting an aquatic source to said tube by a hose at a swivel joint.

16. The method as defined in claim 10, further including the step of surrounding said tubular member within said watercraft by a bushing.

17. The method as defined in claim 10 further including the step of positioning on said tubular member a removable muffler; thereby to control the sound produced by air entering said tubular member and exhausted through said outlet.

18. A method of manufacturing apparatus for powering watercraft comprising the steps of:

(a) fabricating a hollow steering column for extension through a base of said watercraft;

(b) attaching a hollow outlet tube to said steering column below the position where said steering column is designed to extend through said base; and (c) providing means for attaching a pressurized source to said outlet tube.

19. The method as defined in claim 18, wherein said outlet tube is detachable from said pressurized source while said source is connected to said watercraft.

* * * * *